US005771682A

United States Patent [19]

Simons

[11] Patent Number: 5,771,682

[45] Date of Patent: Jun. 30, 1998

[54] THERMAL REACTOR

[75] Inventor: Gary Richard Simons, New Brighton, Minn.

[73] Assignee: Onan Corporation, Minneapolis, Minn.

[21] Appl. No.: 508,981

[22] Filed: Jul. 28, 1995

[51] Int. Cl.[6] ..... F01N 3/18

[52] U.S. Cl. ..... 60/274; 60/282; 60/306

[58] Field of Search ..... 60/306, 282, 274

[56] References Cited

U.S. PATENT DOCUMENTS

| | | | |
|---|---|---|---|
| 2,906,368 | 9/1959 | Nelson . | |
| 3,073,684 | 1/1963 | Williams, Sr. . | |
| 3,088,271 | 5/1963 | Smith . | |
| 3,690,840 | 9/1972 | Volker . | |
| 3,704,592 | 12/1972 | Panhard . | |
| 3,737,286 | 6/1973 | Kofink . | |
| 3,957,446 | 5/1976 | Mayer et al. . | |
| 3,982,397 | 9/1976 | Laurent | 60/306 |
| 3,990,233 | 11/1976 | Will et al. . | |
| 4,055,043 | 10/1977 | Konishi et al. . | |
| 5,437,152 | 8/1995 | Pfefferle | 60/299 |

OTHER PUBLICATIONS

"Development of the Concept of Non–Flame Exhaust Gas Reactors"; J.M. Chandler, et al.; Society of Automotive Engineers, Inc., New York, NY; Mar. 12–16, 1962; 42 pages.

"Thermal Reactor—Design, Development and Performance"; A. Jaimee et al.; 35 pages.

"Design Factors Affecting the Performance of Exhaust Manifold Reactors"; E.N. Cantwell and A.J. Pahnke; E.I. du Pont de Nemours & Co., Inc.; 23 pages.

"A Progress Report on the Development of Exhaust Manifold Reactors"; E.N. Cantwell, et al.; E.I. du Pont de Nemours & Co., Inc.; 32 pages.

*Primary Examiner*—Douglas Hart

*Attorney, Agent, or Firm*—Merchant, Gould, Smith, Edell, Welter & Schmidt, P.A.

[57] ABSTRACT

A thermal reactor for reducing exhaust emissions generated by an engine. The thermal reactor preferably includes an outer housing and an inner core mounted within the outer housing. The inner core defines an expansion chamber which receives exhaust gas from the engine. When the exhaust gas enters the expansion chamber, it expands and becomes thoroughly mixed. While in the expansion chamber, at least some of the exhaust gas is oxidized. A single-layered recirculation chamber is located between the outer housing and the inner core. The recirculation chamber receives the exhaust gas from the expansion chamber and recirculates the exhaust gas around the outer surface of the inner core such that the inner core is insulated. By insulating the inner core with heated exhaust gas from the expansion chamber, the expansion chamber maintains a high temperature which facilitates oxidation of the exhaust gases.

14 Claims, 4 Drawing Sheets

THERMAL REACTOR

FIELD OF THE INVENTION

The present invention relates generally to devices and methods for reducing exhaust emissions. Specifically, the invention relates to thermal reactors and methods for using thermal reactors to reduce exhaust emissions.

BACKGROUND OF THE INVENTION

In 1991, the United States Environmental Protection Agency (EPA) issued a report indicating that lawn and garden equipment generated significant levels of air emissions in the United States. For example, it was estimated lawn and garden equipment was responsible for 1.3–2.6 percent of all manmade hydrocarbon (HC) emissions, 3.9–8.2 percent of all manmade carbon monoxide (CO) emissions, and 0.1 percent of all manmade oxides of nitrogen (NOX) emissions.

Lawn and garden maintenance equipment, snow blowers, and other utility products are generally powered by small utility engines. Small utility engines are typically defined as engines having power ratings at or below 25 horsepower. A problem with small utility engines is that they are not typically equipped with emission control devices. Most emission control devices are designed for automobile engines. These devices, such as catalytic converters, are too complicated, expensive, and fragile to be feasibly incorporated within a small utility engine.

SUMMARY OF THE INVENTION

The present invention relates to a thermal reactor for reducing exhaust emissions generated by an engine. The thermal reactor preferably includes an outer housing and an inner core mounted within the outer housing. The inner core defines an expansion chamber which receives exhaust gas from the engine. When the exhaust gas enters the expansion chamber, it expands and becomes thoroughly mixed. While in the expansion chamber, at least some of the exhaust gas is oxidized. A single-layer recirculation chamber is located between the outer housing and the inner core. The recirculation chamber receives the exhaust gas from the expansion chamber and recirculates the exhaust gas around the outer surface of the inner core such that the inner core is insulated. By insulating the inner core with heated exhaust gas from the expansion chamber, the expansion chamber maintains a high temperature which facilitates oxidation of the exhaust gases.

The present invention also includes a method for reducing exhaust emissions from a small utility engine by oxidizing exhaust gas from the engine. The method preferably includes mixing the exhaust gas from the small utility engine with secondary air to provide sufficient oxygen for facilitating oxidation. The mixture of exhaust gas and secondary air is then directed into an expansion chamber defined by a core such that the exhaust gas and secondary air expand and are thoroughly mixed together. While in the expansion chamber, at least some of the exhaust gas is oxidized.

The present invention provides an improved device for reducing exhaust emissions. The present invention further provides a device for reducing exhaust emissions which is inexpensive and durable. The present invention additionally provides a device for reducing exhaust emissions which is suitable for use in association with small utility engines. Moreover, the present invention relates to an improved method for reducing exhaust emissions emitted by small utility engines.

A variety of advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE INVENTION

Reference will now be made in detail to exemplary embodiments of the present invention which are illustrated in the accompanying drawings. Wherever possible, the same reference numbers will be used throughout the drawings to refer to the same or like parts.

The present invention relates to thermal reactors for small utility engines. In designing exhaust emission control devices for small utility engines, it is important to recognize that small utility engines typically have very different design parameters and operating characteristics than conventional automobile engines. Therefore, emission control devices designed for automobile engines are typically not suitable or practical for small utility engines without significant design modification.

One important difference between small utility engines and automobile engines relates to the overall size of the engines. For example, small utility engines typically have single or twin cylinders and are generally defined as having power ratings that are at or below 25 horsepower. In contrast, automobile engines typically have four to eight cylinders and are designed to generate power levels which greatly exceed 25 horsepower. Because small utility engines typically have single or twin cylinders, they typically have more intense vibration characteristics than automobile engines.

Another difference between small utility engines and automobile engines, is that small utility engines typically operate at relatively constant speeds and typically experience fairly constant loading. Due to the constant speed and loading of small utility engines, small utility engines typically generate fairly constant exhaust emission flow rates. In contrast, automobile engines are subjected to speeds and loads which vary widely thereby resulting in widely varying exhaust emission flow rates.

Another important difference between automobile engines and small utility engines, is that small utility engines are typically air cooled. In contrast, automobile engines are typically liquid cooled. Because small utility engines are typically air cooled, they generally require richer air to fuel ratios in order to help cool the engines. Typical air to fuel ratios for small utility engines are in the range of 12:1 to 13:1. In contrast, modern automobile engines typically operate at much leaner air to fuel ratios in order to maximize fuel economy.

Figure 1:
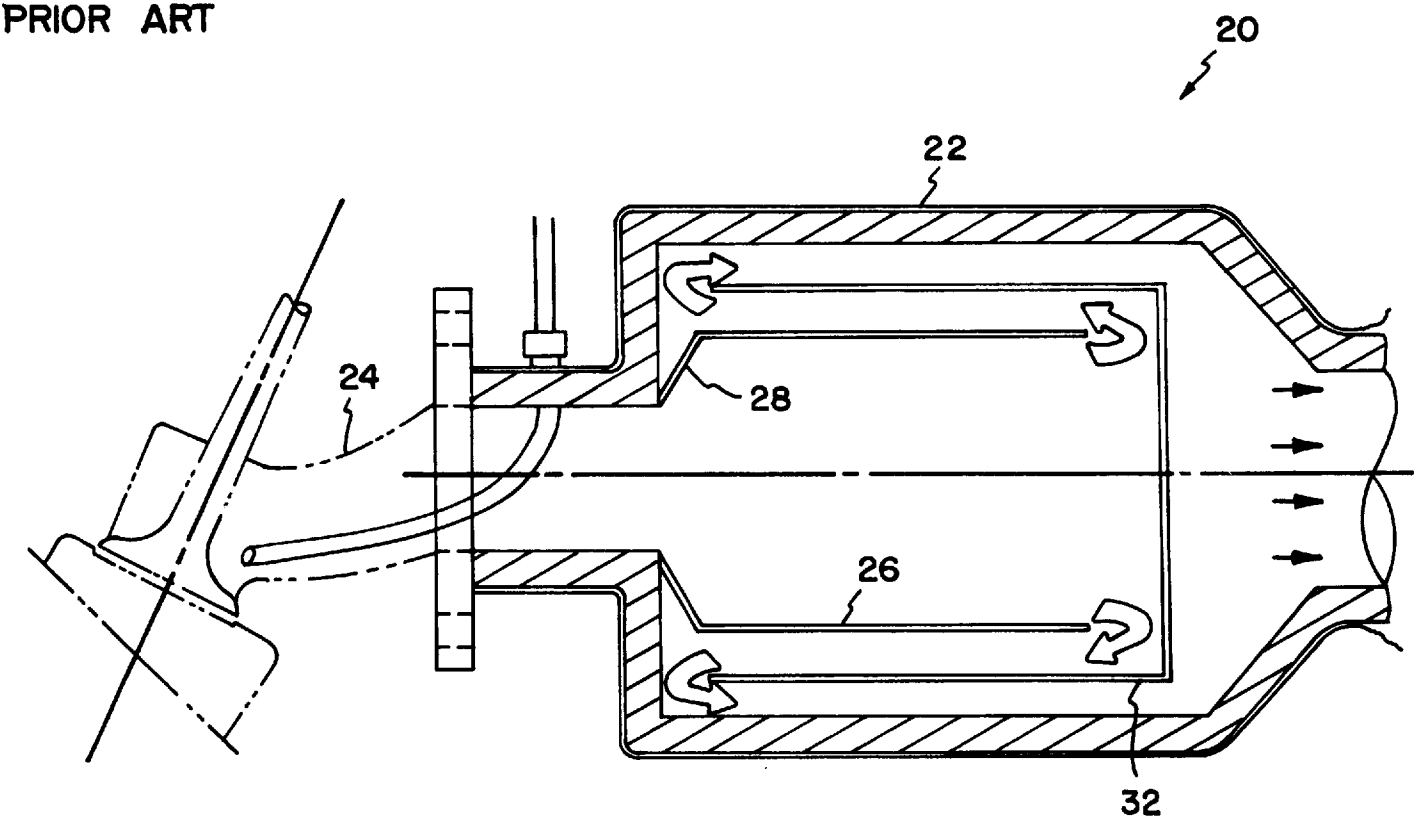
FIG. 1 PRIOR ART
FIG. 1 is schematic diagram of a prior art emission control device designed for use with an automobile engine.

FIG. 1 shows a conceptual prior art labyrinth can reactor 20 proposed for use on an experimental automobile engine. The labyrinth can reactor 20 includes an outer housing 22 connected directly to an exhaust port 24 of an automobile engine. An inner core 26 is mounted within the outer housing 22. The inner core has a tapered inlet end 28 which connects to the outer housing 22 and an outlet end 30 which is open. The labyrinth can reactor 20 also includes a baffling member 32 positioned between the inner core 26 and the outer housing 22. The baffling member 32 creates multiple recirculation layers for recirculating exhaust gas which exits the inner core 26. After the exhaust gas has travelled through the multiple recirculation layers, the exhaust gas exits axially from the outer housing 22.

The design of the labyrinth can reactor 20 presents problems for use in combination with small utility engines. For example, the baffling member 32 rapidly degrades when exposed to the high operating temperatures and intense vibrations associated with small utility engines. Furthermore, the design of the inner core 26 does not maximize mixing of the exhaust gas thereby causing reduced thermal reactor efficiency.

Figure 2:
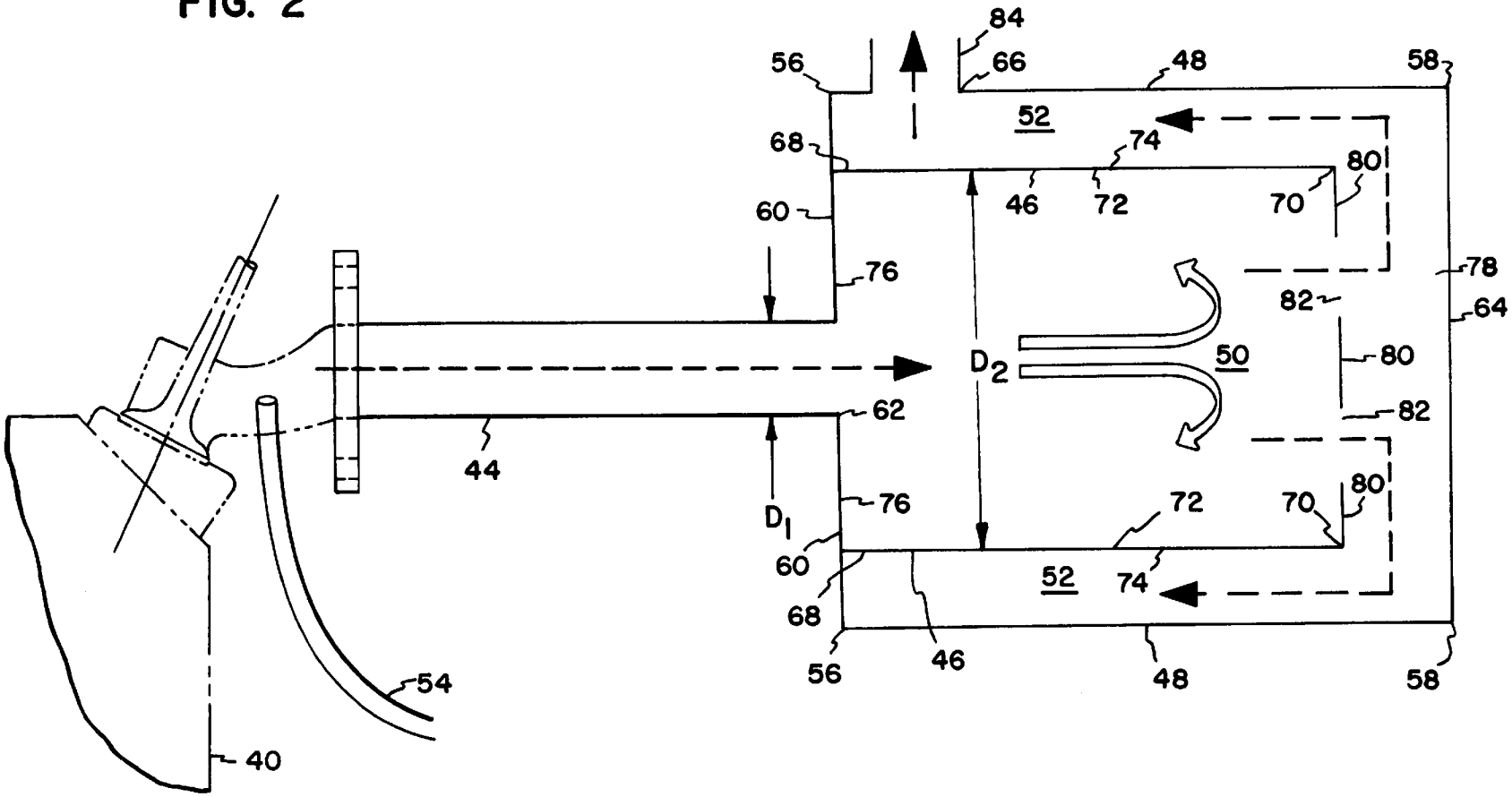
FIG. 2 is a schematic diagram of a thermal reactor constructed in accordance with the principles of the present invention.

FIG. 2 shows a thermal reactor 42 constructed in accordance with the principles of the present invention. Generally, the thermal reactor 42 includes an inner core 46 mounted within an outer housing 48. The inner core 46 preferably defines an expansion chamber 50 for receiving exhaust gas from the exhaust port of a small utility engine 40. A single-layer recirculation chamber 52 is preferably located between the inner core 46 and the outer housing 48. The recirculation chamber 52 preferably receives exhaust gas from the expansion chamber 50 and recirculates the exhaust gas around the inner core 46 such that the inner core 46 is insulated. The thermal reactor 42 also preferably includes a means for injecting secondary air 54 into the exhaust gas before the exhaust gas enters the expansion chamber 50.

In basic operation, exhaust gas exits the small utility engine 40 through the exhaust port and flows to the thermal reactor 42. Before the exhaust gas from the small utility engine 40 enters the expansion chamber 50 of the thermal reactor 42, the means for injecting secondary air 54 injects secondary air into the stream of exhaust gas. The secondary air provides additional oxygen which is necessary for oxidizing unburned hydrocarbons (HC) and carbon monoxide (CO) within the expansion chamber 50. The mixture of exhaust gases and secondary air then enter the expansion chamber 50 causing the exhaust gas and secondary air expand and become thoroughly mixed.

The expansion chamber 50 is designed to foster thorough mixing of the secondary air and the exhaust gas within the expansion chamber 50 thereby maximizing oxidation rates and reducing HC and CO emissions. While in the expansion chamber 50, at least some of the hydrocarbon and carbon monoxide in the exhaust gas are oxidized to form carbon dioxide and water. Heat released from the oxidation reaction further elevates the gas temperature within the expansion chamber 50 thereby causing additional oxidation.

After spending a residence time in the expansion chamber 50, the exhaust gas exits the expansion chamber 50 and enters the recirculation chamber 52 where it surrounds and insulates the inner core 46 thereby assisting in maintaining a high inner core temperature. Finally, the exhaust gas exits the thermal reactor 42. Due to the oxidation that occurred in the expansion chamber, the exiting exhaust gas has reduced levels of CO and HC.

The previous paragraphs provided a general description of the present invention. It will be appreciated that the following paragraphs provide a more detailed description of the specific embodiment depicted in FIG. 2.

It is preferred for each of the components of the thermal reactor 42 to be constructed of an inexpensive metal capable of resisting high temperatures and oxidation. A preferred material employed for manufacturing the thermal reactor 42 is 16 gauge 310 stainless steel. Other materials such as "Hastalloy" and "Inconel" may also be used. It will be appreciated that each of the reactor 42 components are preferably interconnected by conventional means such as welding. It will further be appreciated that coatings such as aluminum oxide and chromium-aluminum may also be employed to prevent deterioration of the metals.

The outer housing 48 of the thermal reactor 42 is preferably a hollow cylinder having a first end 56 positioned opposite a second end 58. The first end 56 is preferably enclosed by a first circular end plate 60 which is preferably welded to the first end 56 of the housing 48. The first circular end plate 60 preferably has a centrally located inlet opening 62 which is preferably circular and has a first diameter $D_1$. The second end 58 of the housing is preferably enclosed by a second circular end plate 64 which is preferably welded to the second end 58 of the housing 48. The generally cylindrical outer housing 48 also preferably defines a circular outlet opening 66 which is located generally adjacent to the first end 56 of the housing 48.

Due to the high operating temperatures of the thermal reactor 42, it may be desirable to insulate the outer surface of the outer housing 48. It will be appreciated that a variety of conventional insulating techniques may be employed to insulate the outer surface of the cylindrical housing 48.

The inner core 46 of the thermal reactor 42 is preferably formed in the shape of hollow cylinder which is concentrically mounted within the outer housing 48. The inner core 46 preferably defines a cylindrical expansion chamber 50 having a diameter $D_2$ which is preferably in the range of three to ten times greater than the diameter $D_1$ of the inlet opening 62. More preferably, the diameter $D_2$ is in the range of three to six times the diameter $D_1$ of the inlet opening 62. Most preferably, the diameter $D_2$ is 4.5 times greater than the diameter $D_1$ of the inlet opening 62.

The cylindrical inner core 46 preferably includes an inlet end 68 opposite from an outlet end 70 and an interior surface 72 opposite from an exterior surface 74. The inlet end 68 of the inner core 46 is preferably connected directly to the interior surface of the first circular end plate 60 of the housing 48 by conventional means such as welding. The inlet end 68 is preferably aligned generally perpendicular to the first circular end plate 60 such that the end plate 60 forms a radial section 76 that extends generally perpendicularly between the interior surface 72 of the inner core 46 and the outer perimeter of the inlet opening 62.

The outlet end 70 of the inner core 46 is preferably spaced from the second circular end plate 64 of the housing 48 such that a recirculation gap 78 is defined therein between. Additionally, the outlet end 70 of the inner core 46 is preferably enclosed by a circular end cap 80 which is preferably connected to the outlet end 70 by conventional means such as welding or a bolt assembly. The circular end cap 80 is preferably aligned transversely with respect to the inner core 46 and preferably defines at least one discharge opening for allowing the exhaust gas to axially/longitudinally exit the inner core 46 of the thermal reactor 42.

A preferred end cap 80 embodiment has a pair of discharge openings 82 located on opposite sides of a center of the circular end cap 80. The discharge openings 82 are preferably aligned along a line which bisects the circular end cap 80. Additionally, the discharge openings 82 are preferably located at midpoints between the center of the circular end cap 80 and the outer perimeter of the circular end cap 80.

A variety of factors control the efficiency in which CO and HC are oxidized within the expansion chamber 50. A primary factor governing the oxidation reaction is the temperature within the expansion chamber 50. A preferred operating temperature within the expansion chamber 50 is in the range of 700° Celsius to 1000° Celsius. In order to maintain such high temperatures, it is desirable to locate the thermal reactor 42 as close to the engine 40 as is reasonably possible. By placing the thermal reactor 42 close to the engine 40, the heated exhaust gases which exit the engine 40 are not given the opportunity to cool before reaching the thermal reactor 42. Additional heating within the expansion chamber is provided by the oxidation reactions which occur within the expansion chamber 50.

Another factor controlling the effectiveness of the thermal reactor 42 is the residence time which the exhaust gas spends within the expansion chamber 50. It is desirable for the expansion gas to spend sufficient time within the expansion chamber 50 to allow a large percentage of the CO and HC within the exhaust gas to be oxidized. Several formulas empirically developed by the automobile industry for determining proper reactor sizes for automobile engines are applicable to the present invention. For example, a formula proposed in SAE Paper No. 730203, 1973 entitled "Reactor Studies for Exhaust Oxidation Rates" by Lord et al. has been determined by the inventor to be suitable for determining a proper volume size for the expansion chamber 50. Lord et al. proposed the following formula:

$$V = \frac{C_o F_o - CF}{(15{,}144e^{-14200/T})(P_{co}^{.27})}$$

Where:

V=Reactor Volume (cubic inches)

$C_O$=CO mass concentration entering reactor $F_O$=Mass flow entering reactor (Kilograms per hour)

C=CO mass concentration inside and leaving reactor

F=Mass flow inside and leaving reactor (Kilograms per hour)

$P_{CO}$=CO partial pressure (PSI)

T=Reactor gas temperature (Degrees R)

Based on the above equation, a spreadsheet may be created to predict the expansion chamber volume necessary to achieve various ranges of mass CO removal at varying core gas temperatures. The chamber volume may also be calculated for different secondary air injection rates.

Figure 3:
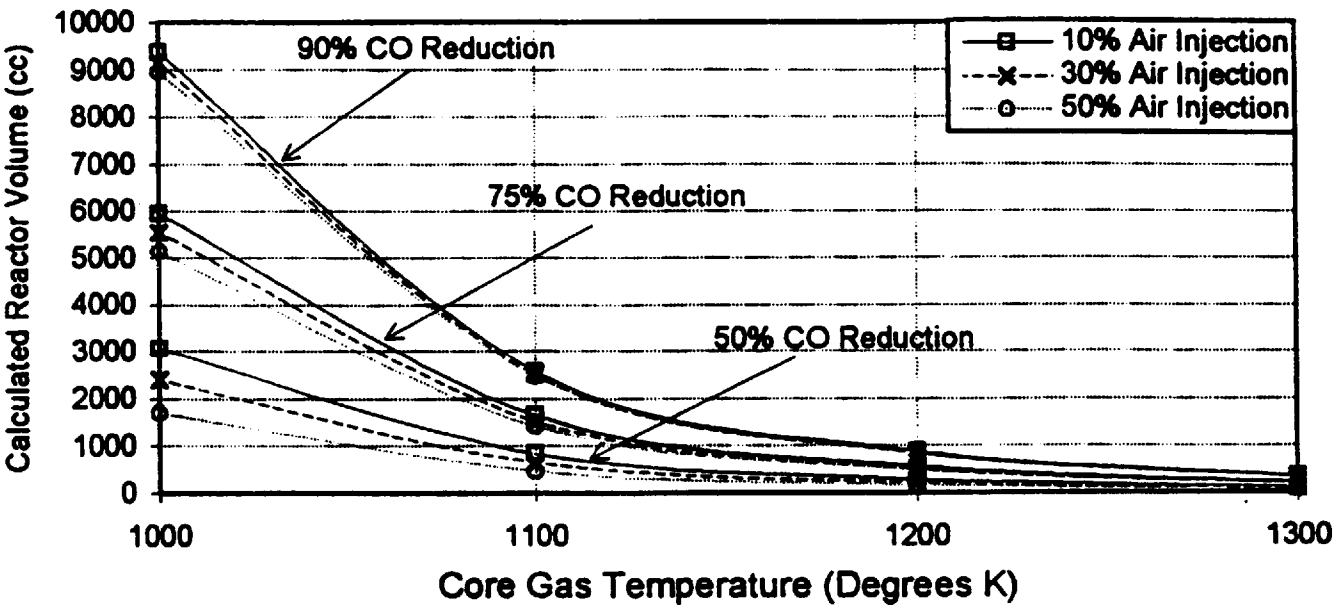
FIG. 3 is a graph for calculating an effective expansion chamber volume for the device of FIG. 2.

FIG. 3 illustrates a graph generated from the above-described formula illustrating the operating volumes of the expansion chamber calculated to achieve 50%, 75%, and 90% carbon monoxide reduction over a range of inner core gas temperatures. The graph also illustrates the effect of varying the secondary air injection rates.

It will be appreciated that the above formula is just one manner of determining the proper operating volume of the expansion chamber 50. It will be appreciated that other empirical formulas and material balance and reaction kinetic equations may also be used.

In order for the thermal reactor 42 to function properly, it is important for the residence time of each exhaust gas molecule within the expansion chamber to not significantly deviate from the average residence time of all of the exhaust gas. In this regard, it is important that the exhaust gas within the expansion chamber 50 be thoroughly mixed. The inner core 46 has a variety of structures which insure that the exhaust gas is thoroughly mixed. For example, the perpendicular radial section 76 located between the outer perimeter of the inlet openings 62 and the interior surface 72 of the inner core 46 allows exhaust gas entering the expansion chamber 50 to instantly and turbulently expand. Unlike the prior art reactor of FIG. 1, there is no transition zone between the inlet opening 62 and the inner core 46. The perpendicular section 76 causes the exhaust gas entering the expansion chamber to rapidly expand and to flow in an eddy pattern within the expansion chamber 50 thereby enhancing thorough mixing of the exhaust gas.

Additionally, unlike the prior art reactor of FIG. 1, the thermal reactor of the present invention includes the circular end cap 80 which encloses the outlet end 70 of the expansion chamber 50. The circular end cap 80 enhances mixing and prevents exhaust gas from prematurely flowing from the expansion chamber 50 to the recirculation chamber 52.

The recirculation chamber 52 of the thermal reactor 42 is preferably located between the inner core 46 and the outer housing 48. The recirculation chamber 52 is preferably annular shaped and in fluid communication with recirculation gap 78 defined between the outlet end 70 of the inner core 46 and the second circular end plate 64 of the housing 48. It is preferred for the recirculation chamber 52 to be a single layer. The recirculation chamber is preferably in fluid communication with the outlet opening 66 which is located generally adjacent to the first end 56 of the housing 48.

In typical operation, heated oxidized exhaust gas axially exits the expansion chamber 50 through the discharge openings 82 of the circular end cap 80. From the expansion chamber 50, the heated exhaust gas enters the recirculation gap 78 and reverses directions generally 180° to flow into the annular recirculation chamber 52. The heated exhaust gas then flows through the recirculation chamber 52 towards the first end 56 of the housing 48. As the heated exhaust gas flows through the recirculation chamber 52, it forms a heated single insulation layer which insulates the exterior surface 74 of the inner core 46. By insulating the exterior surface 74 of the inner core 46, the heated exhaust gas assists in maintaining high temperatures within the expansion chamber 50.

The heated exhaust gas preferably radially/transversely exits the recirculation chamber 52 through the outlet opening 66 that is preferably located within the cylindrical housing wall adjacent to the first end 56 of the housing 48. It is preferred for an outlet pipe 84 to be connected to the outlet opening 66 for directing the heated exhaust gas away from the thermal reactor 42. In a preferred configuration, the outlet pipe 84 extends radially and perpendicularly outward from the outer cylindrical surface of the outer housing 48.

The thermal reactor 42 of FIG. 2 is preferably connected to the engine 40 by an adaptor pipe 44 which extends from the engine port to the thermal reactor 42. It will be appreciated that the adaptor pipe 44 facilitates spacing the thermal reactor away from the engine 40. Spacing is important because most small utility engines are air cooled and require adequate air circulation about the exhaust port to prevent overheating. However, it will be appreciated that it may be preferable in certain circumstances to connect the thermal reactor 42 directly to the exhaust port of the engine.

It will be appreciated that the adaptor pipe 44 should be long enough to allow the engine 40 to properly cool, and short enough to prevent significant heat loss of the exhaust gas as it travels from the engine 40 to the expansion chamber 50.

It is preferred for the adaptor pipe 44 to be aligned such that it directs the exhaust gas axially into the expansion chamber 50. By directing the exhaust gas axially into the expansion chamber 50, mixing of the exhaust gas within the expansion chamber is enhanced and the flow of heated exhaust gas does not impinge directly upon the interior surface 72 of the inner core 46.

The lack of impingement on the interior surface 72 of the inner core 46 serves two basic purposes. First, the lack of direct impingement on the interior surface 72 reduces deterioration of the inner core 46 caused by direct exposure to the heated exhaust gases. Second, by minimizing contact between the exhaust gases and the interior surface 72 of the inner core 46, quenching of the exhaust gases on the cooler interior surface 72 of the inner core 46 is reduced thereby helping to enhance elevated temperatures within the expansion chamber 50.

Figure 4:
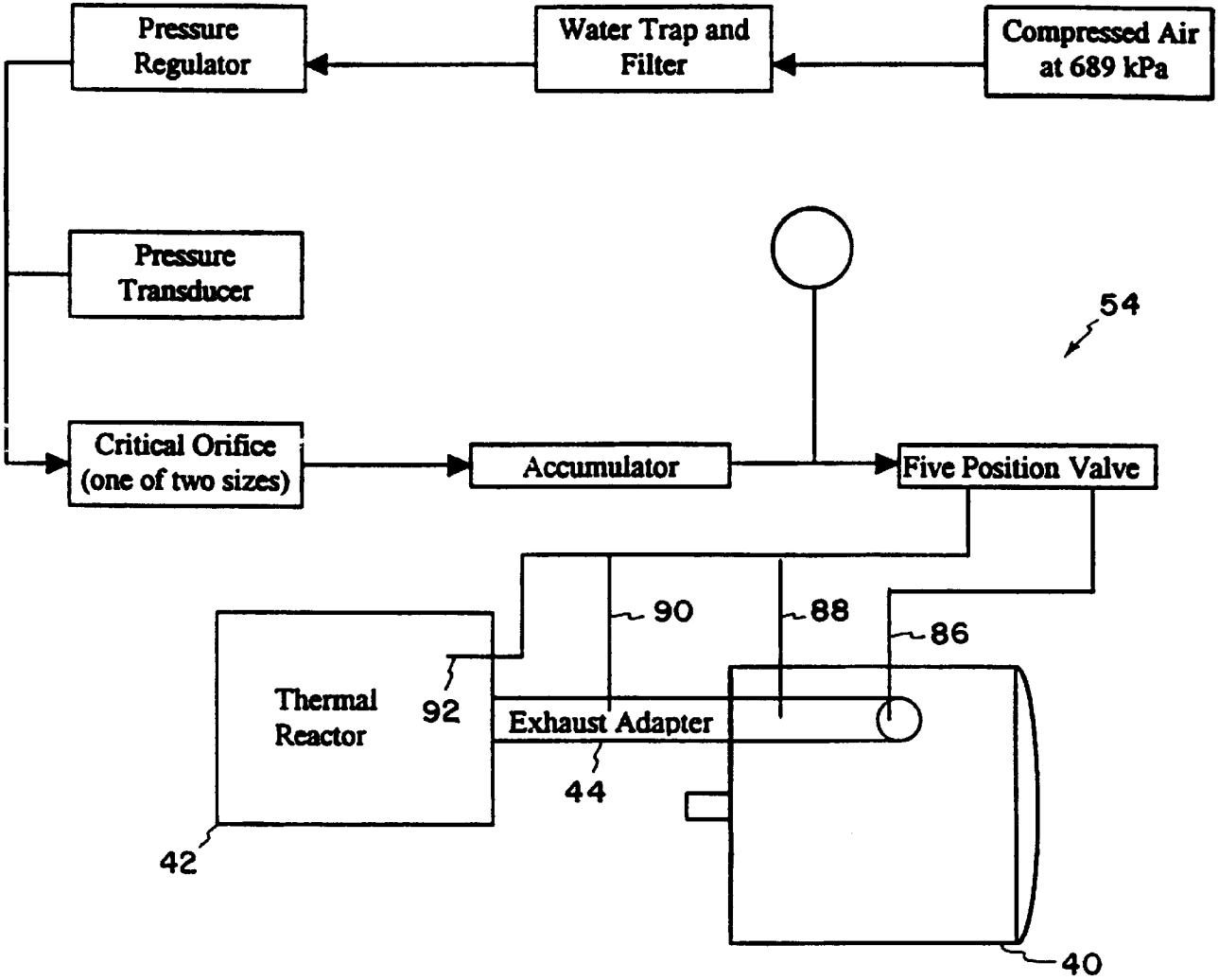
FIG. 4 is a schematic diagram showing various secondary air injection locations for the device of FIG. 2.

As previously described, the thermal reactor 42 preferably employs a means for injecting secondary air 54 in order to enhance oxidation within the expansion chamber 50. FIG. 4 shows a configuration for injecting secondary air into the stream of exhaust gas. For testing purposes, compressed secondary air is provided from a shop air line to one of four locations along the flow path of the exhaust gas. First and second locations 86 and 88 are within the exhaust port of the engine 40. A third location 90 is located along the adapter pipe 44. A fourth location 92 is located within the expansion chamber 50 of the thermal reactor 42. It is preferred for the secondary air to be injected in a direction generally perpendicular to the flow of the exhaust gas in order to minimize backpressure.

It will be appreciated that secondary air flow rates should be high enough to supply the necessary oxygen for allowing the oxidation reaction within the expansion chamber, but not so great so as to overly cool the exhaust gases and lower the reactor temperature. For most engines, secondary air flow rates range between 5 to 40 percent of the engine flow rate. Assuming an engine air to fuel ratio ranging between 11:1 to 13:1, preferred secondary air flow rates are in the range of 15 to 25 percent of the engine flow rate. Assuming an engine air to fuel ratio of 12:1, a preferred secondary air injection rate is 20 percent of the engine flow rate. It will be appreciated that flow rates through the thermal reactor 42, which include the exhaust gases from the engine 40 and the secondary air, are typically in the range of 14 kg/hr–35 kg/hr.

It will be appreciated that for use with conventional small utility engines, it is not practical to employ a shop line for injecting secondary air into the exhaust stream. Therefore, it is preferable to employ alternative means for injecting secondary air into the exhaust stream. For example, secondary air may be passively injected into the exhaust stream by such means as pulse air valves, exhaust ejectors (exhaust venturi), or crank case pulse driven pumps which are preferably connected to the engine exhaust port or the adapter pipe 44. Additionally, secondary air may be provided by active injection means such as belt driven air pumps or electric pumps.

The following are illustrative dimensions for a thermal reactor which was designed for a 303 cubic centimeter air cooled single cylinder utility engine. The adapter pipe 44 preferably has a diameter equal to one inch. The inner core preferably has a diameter equal to 4.5 inches such that the diameter variance between the adapter pipe and the expansion chamber is approximately 4.5 to 1. The axial length of the inner core 46 is preferably 6.3 inches such that the volume of the expansion chamber is approximately 100 cubic inches. The diameters of the discharge openings are preferably 0.71 inches. The diameter of the outer housing is preferably 6.5 inches while the axial length of the outer housing is preferably 7.3 inches. Finally, the diameter of the outlet opening and outlet pipe is approximately 1 inch. It will be appreciated that the previously described dimensions are strictly illustrative and are not to be construed as a limitation upon the invention.

With regard to the foregoing description, it is to be understood that changes may be made in detail, especially in matters of construction materials employed and the shape, size and arrangement of the parts without departing from the scope of the present invention. It is intended that the specification and depicted embodiment be considered exemplary only, with a true scope and spirit of the invention being indicated by the broad meaning of the following claims.

What is claimed is as follows:

1. A thermal reactor used with a small utility engine comprising:

an outer housing having an inlet opening for receiving exhaust gas from the engine, and an outlet opening for allowing the exhaust gas to exit the thermal reactor;

an inner core mounted within the outer housing and defining an expansion chamber for receiving the exhaust gas through the inlet opening, wherein the exhaust gas expands as it enters the expansion chamber, and at least some of the exhaust gas is oxidized within the expansion chamber; and wherein the outer housing and the inner core together define only one recirculation chamber located therein-between for receiving the exhaust gas from the expansion chamber, recirculating the exhaust gas around the inner core, and directing the exhaust gas toward the outlet opening.

2. The thermal reactor of claim 1, further comprising means for injecting secondary air into the exhaust gas before the exhaust gas enters the expansion chamber.

3. The thermal reactor of claim 1, wherein the outer housing and the inner core are each hollow cylinder shaped, and the inner core is mounted concentrically within the outer housing.

4. The thermal reactor of claim 3, further comprising an adaptor pipe in fluid communication with the engine and the expansion chamber for directing exhaust gas through the inlet opening into the expansion chamber, the adaptor pipe being in axial alignment with the inner core such that the exhaust gas flows axially into the expansion chamber.

5. The thermal reactor of claim 3, wherein the inner core has an interior surface and an exterior surface, and the inner core has an inlet end having a radial section which extends generally perpendicularly between the inlet opening and the interior surface of the inner core.

6. The thermal reactor of claim 3, wherein the inner core has an outlet end which is enclosed by an end cap, the end cap being transversely aligned with respect to the inner core and defining one or more discharge openings for allowing the exhaust gas to flow axially from the expansion chamber to the recirculation chamber.

7. The thermal reactor of claim 3, wherein the outlet opening is aligned such that the exhaust gas that exits the recirculation chamber through the outlet opening flows radially outward from the housing.

8. A thermal reactor comprising:

a hollow cylindrical housing having a first end opposite a second end, the first end being enclosed by a first circular end plate defining a centrally located inlet opening having a first diameter, the second end being enclosed by a second circular end plate, and the housing defining an outlet opening located generally adjacent to the first end;

a hollow cylindrical inner core generally concentrically mounted within the housing and defining an expansion chamber having a second diameter larger than the first diameter of the inlet opening, the inner core including an inlet end opposite an outlet end and an interior surface opposite an exterior surface, the inlet end of the inner core being attached to the first end wall of the housing, the outlet end of the inner core being spaced from the second end wall of the housing such that a recirculation gap is defined thereinbetween, and the outlet end of the inner core being enclosed by an end cap having one at least discharge opening; and wherein the inner core and the housing define only one annular recirculation chamber located thereinbetween for recirculating oxidized gases from the expansion chamber about the exterior surface of the inner core.

9. The thermal reactor of claim 8, wherein the exhaust gas flows axially through the discharge opening into the recirculation gap, reverses directions generally 180 degrees and flows from the recirculation gap into the recirculation chamber, flows through the recirculation chamber toward the first end of the housing, and transversely exits the recirculation chamber through the outlet opening.

10. The thermal reactor of claim 8, wherein the end cap is aligned transversely with respect to the inner core and has two spaced-apart discharge openings, the discharge openings being located on opposite sides of a center of the end cap.

11. The thermal reactor of claim 8, wherein the inlet end of the inner core has a radial section extending substantially perpendicularly between the inlet opening and the interior surface of the inner core.

12. The thermal reactor of claim 8, wherein the second diameter of the expansion chamber is 3 to 10 times larger than the first diameter of the inlet opening.

13. A method for oxidizing exhaust gas from a small utility engine comprising:

mixing the exhaust gas from the small utility engine with secondary air to provide oxygen for facilitating oxidation;

directing the mixture of exhaust gas and secondary air into an expansion chamber defined by a core such that the exhaust gas and the secondary air expand and are mixed, and at least some of the exhaust gas is oxidized without burning the mixture; and providing an outer housing surrounding the core to thereby define only one recirculation chamber between the core and the housing, and recirculating the exhaust gas and secondary air mixture from the expansion chamber into the one recirculation chamber such that the expansion chamber is insulated.

14. A thermal reactor used with a small utility engine comprising:

an outer housing having an inlet opening for receiving exhaust gas from the engine, and an outlet opening for allowing the exhaust gas to exit the thermal reactor;

an inner core mounted within the outer housing and defining an expansion chamber for receiving the exhaust gas through the inlet opening, wherein the exhaust gas expands as it enters the expansion chamber, and at least some of the exhaust gas is oxidized within the expansion chamber; and wherein the inner core has an interior surface and an exterior surface, and the inner core has an inlet end having a radial section which extends generally perpendicularly between the inlet opening and the interior surface of the inner core.

* * * * *